United States Patent [19]

McManama

[11] 4,102,278

[45] Jul. 25, 1978

[54] FURNACE HOGGED FUEL DISPERSER USING MODULATED AIRFLOW

[75] Inventor: Gerald P. McManama, Seattle, Wash.

[73] Assignee: Wyatt Engineers, Inc., Seattle, Wash.

[21] Appl. No.: 795,768

[22] Filed: May 11, 1977

[51] Int. Cl.[2] ..... F23K 3/02

[52] U.S. Cl. ..... 110/105; 214/21; 302/42

[58] Field of Search ..... 110/8, 12, 102, 104 R, 110/104 A, 104 B, 105; 214/21; 302/19, 42, 50

[56] References Cited

U.S. PATENT DOCUMENTS

| | | | |
|---|---|---|---|
| 477,387 | 6/1892 | Scott et al. | 110/102 |
| 586,265 | 6/1897 | Beebe et al. | 110/104 A |
| 1,311,524 | 7/1919 | Lee | 110/105 |
| 1,455,576 | 5/1923 | Barnes | 110/105 |
| 1,959,864 | 5/1934 | Hartley | 302/50 |
| 2,178,360 | 10/1939 | Kohout | 214/21 |
| 2,602,706 | 7/1952 | Miller et al. | 302/19 |
| 3,137,529 | 6/1964 | Allen et al. | 302/42 |
| 3,610,182 | 10/1971 | Stockman | 110/12 |
| 3,669,502 | 6/1972 | Leman | 302/19 |
| 3,812,794 | 5/1974 | Taylor | 110/8 |

*Primary Examiner*—Kenneth W. Sprague

*Attorney, Agent, or Firm*—Christensen, O'Connor, Johnson & Kindness

[57] ABSTRACT

Combustion air under pressure directed horizontally in a fan shaped jet against hogged fuel dropping in a free fall trajectory from a feed chute toward the furnace grate spreads the fuel across the length and width of the grate more effectively than in prior art air jet dispersers. Increased combustion efficiency and heating capacity are achieved from use of tandem oscillating flow restrictor gates in the jet nozzle duct, one such gate being oscillated at twice the frequency of the other and with additive effects on resultant variations in jet air discharge velocity.

10 Claims, 4 Drawing Figures

FURNACE HOGGED FUEL DISPERSER USING MODULATED AIRFLOW

BACKGROUND OF THE INVENTION

This invention relates to improvements in air jet dispersing devices for hogged fuel burning furnaces, and more particularly, to improvements in the means by which combustion air fuel dispersing jet velocity is varied as a function of time in order to improve the time-averaged uniformity of fuel combustion activity over the area of the grate, thereby providing increased efficiency and heating capacity of the furnace. The invention is herein illustratively described by reference to the presently preferred embodiment hereof. However, it will be recognized that certain modifications and changes therein with respect to details may be made without departing from the essential features involved.

The concept of dispersing hogged fuel over the area of a furnace grate using a fan shaped air jet intersecting the path of descent of fuel particles being fed to the fire box in a free fall trajectory is old in the art. Also previously recognized was the advantage to be gained from periodically varying the rate of air flow in the jet. Prior art references of varying degrees of interest and pertinence to the subject generally are as follows (United States Patents):

| Patent No. | Inventor | Issued |
|---|---|---|
| 477,387 | Scott et al. | 6/21/1892 |
| 1,311,524 | H. G. Lee | 7/29/19 |
| 1,959,864 | O. A. Hartley | 5/22/34 |
| 2,178,360 | G. A. Kohout | 10/31/39 |
| 2,602,706 | Miller et al. | 7/8/52 |
| 3,137,529 | Allen et al. | 6/16/64 |
| 3,610,182 | Richard F. Stockman | 10/5/71 |
| 3,669,502 | Marvin J. Leman | 6/13/72 |
| 3,812,794 | Fred W. Taylor | 5/28/74 |

The present invention is directed broadly to further improving the efficiency and volumetric capability of hogged fuel burning furnaces. More specifically, it is an object hereof to improve the time-averaged fuel dispersal uniformity over the area of the furnace grate in a manner conducive to maximum combustion efficiency and rate, without unduly complicating the construction, or the criticality of adjustment and operation of the system. A further and related object hereof is to devise an improved air jet fuel dispersal system employing a new and improved technique or mode of combustion air jet velocity modulation.

Still another object hereof is to devise a fuel dispersal system using modulated combustion air velocity that is readily adjustable to suit varying operating conditions, such as heterogeneous fuel particle size, or moisture variance or density (i.e., air dispersability) and combustability. A further and related objective is to achieve more uniform distribution over the fuel bed of large and small particles and dense and light particles making up the heterogeneous fuel.

BRIEF DESCRIPTION OF INVENTION

In accordance with this invention, hogged fuel discharging in a free fall trajectory from a fuel delivery chute or the like is subjected to the force of a horizontally directed, fan shaped jet of combustion air issuing from an orifice directed over the furnace grate to intersect the fuel trajectory and transport the fuel outwardly and over the area of the adjacent furnace grate, generally as in certain prior arrangements. However, in the present system the air jet velocty is modulated, not by a single oscillated flow restrictor or the like, but by two tandemly positioned flow restrictor gates, one oscillated a submultiple (half) of the frequency of the other. The composite effect of these dual modulating flow restrictor gates is optimized when the oscillation phasing of the gates is so related that the gates reach their most fully closed positions at substantially the same instant on alternate cycles of the more rapidly oscillated gate.

As a further feature hereof, the average position of each of the oscillating gates is independently adjustable so as to vary the contributive effect thereof on average air jet velocity.

These and other features, objects and advantages of the invention will become more fully evident from the following description by reference to the accompanying drawings.

DETAILED DESCRIPTION REFERRING TO DRAWINGS

Figure 1:
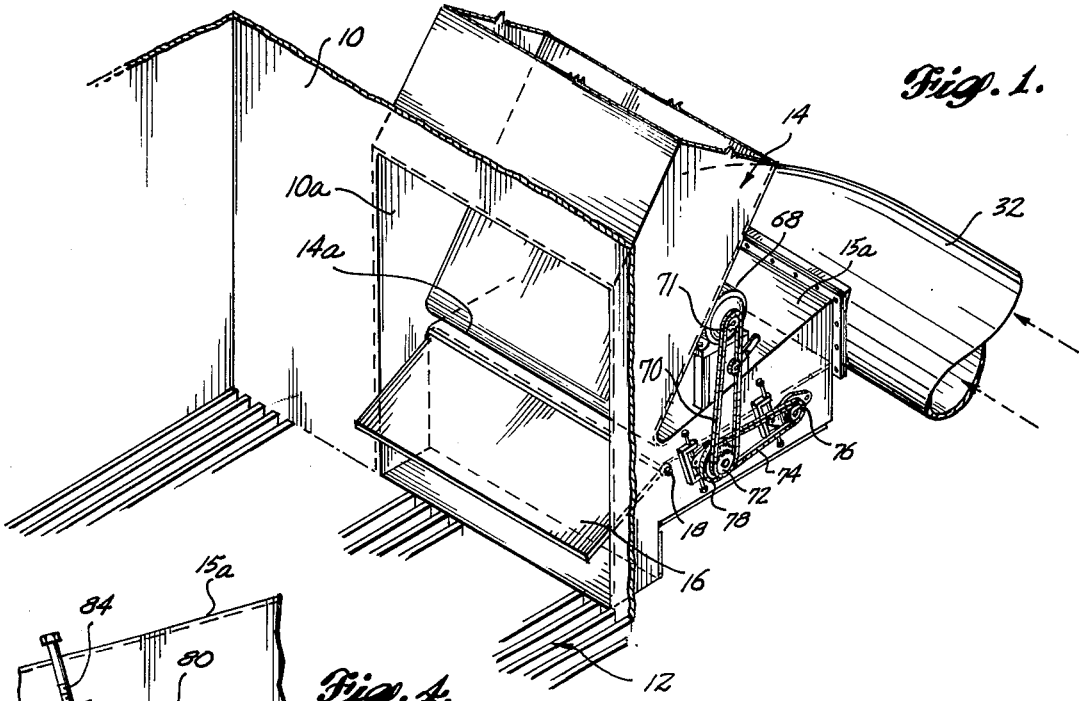
FIG. 1 is a top perspective view of a portion of a furnace fire box with fuel feed chute in association with the improved air dispersal tandem oscillating gate mechanism, as viewed from an assumed position overlying and at one side of the furnace fire box.
Figure 4:
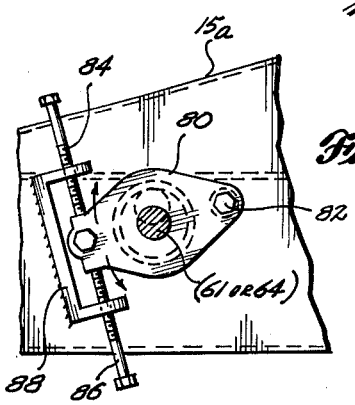
FIG. 4 is a side view on an enlarged scale of the preferred means for adjusting the average flow restricting position of each of the oscillating gates.
Figure 3:
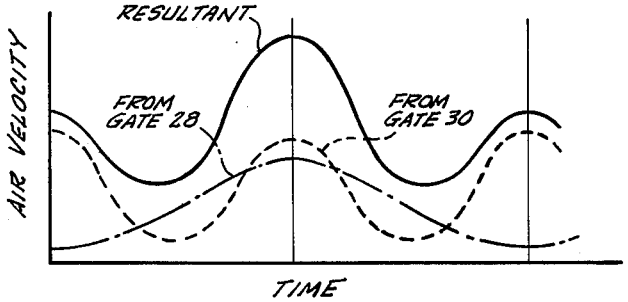
FIG. 3 is a graph depicting approximately, as a function of time, the airflow velocity variation produced by each of the two oscillating gates and the resultant produced by the composite of their effects.
Figure 2:
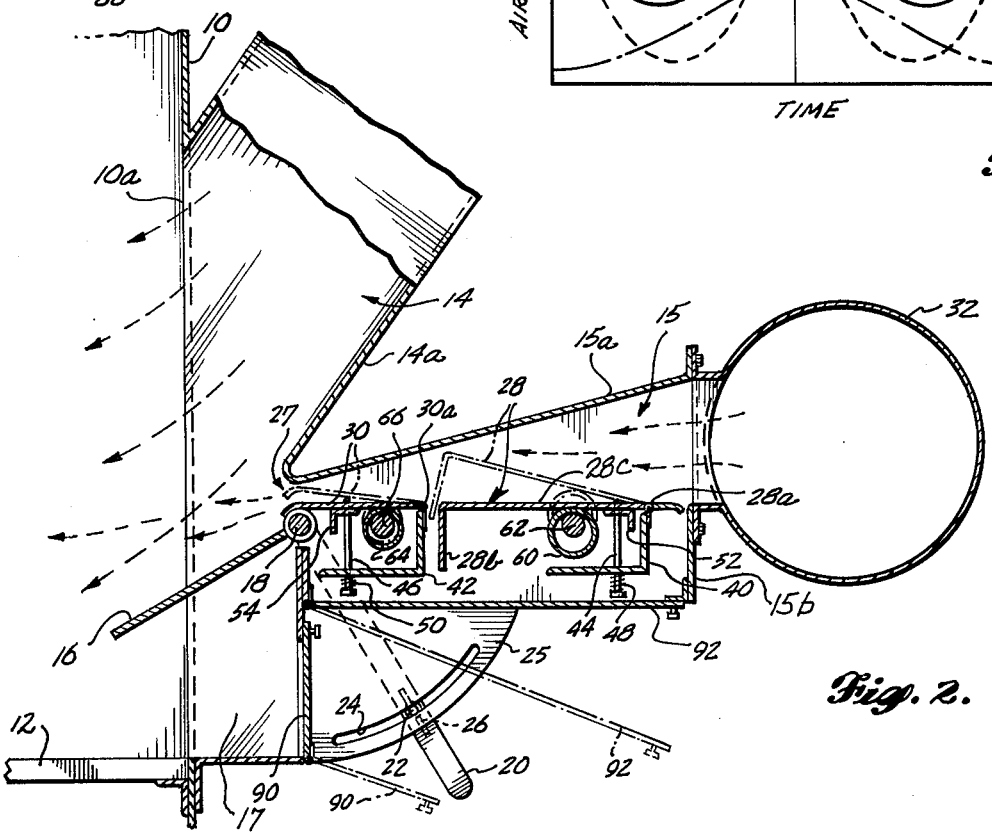
FIG. 2 is a vertical longitudinal sectional view of the apparatus shown in FIG. 1 on an enlarged scale.

As shown in the drawings, the partially outlined furnace fire box 10 and fire box grate 12 are customarily of rectangular shape in horizontal planes, the box, for example, being five feet wide and ten feet long and typically underlying a furnace boiler or other heat exchanger. Hogged fuel to be burned in the fire box is fed through a fire box wall opening 10a transversely centered in one end wall of the fire box at a location extending from and above the level of the grate 12. Hogged fuel (i.e., a heterogeneous mixture of wood/bark, chips, splinters and other fragments of diverse sizes, shapes and densities) is delivered from a supply hopper (not shown) in which it is customary to incorporate a power-driven auger forcing fuel out of the hopper and into the fuel delivery chute 12 at a suitable rate that typically can be adjusted to satisfy heat requirements.

Outside the opening 10*a* and at a level above the grate, the chute 14 terminates so as to discharge the fuel in a free fall trajectory toward the grate through the opening 10*a*. An adjustable inclined fuel deflector ramp 16 underlying the lower end of the chute 14 extends into the opening 10*a* above the grate 12. This ramp serves as a deflector for those denser or heavier fuel particles that pass through the dispersal air stream so as to direct them lengthwise of the grate by varying distances depending upon their impact velocity on the ramp, ramp slope angle, particle resilience, etc. Ramp 16, mounted on a horizontal pivot shaft 18, may be adjusted to different slope angles so as to control this effect. Ramp position is set by a control arm 20 clamped in any of different angular positions by means of a stud 22 that projects through an arcuate slot 24 in a guide plate 25 and carries a wing nut 26 that may be loosened in order to shift the angular position of the ramp.

In the practice of this invention, as in certain prior devices, a large proportion of the descending fuel particles intercepted by the fan shaped, horizontally directed jet of air issuing through orifice 27 are blown lengthwise and laterally of the fuel grate so as to spread them out over the area of the grate as they settle upon it. Horizontally elongated orifice 27 in this embodiment is formed at its upper edge by the intersection between the bottom panel 14*a* of chute 14 and the sloping top wall panel 14*a* of tapered (in a vertical plane) nozzle duct 14. The lower edge of orifice 27 is formed by the free swinging end of flow restrictor gate 30 overlapping the pivoted upper end of ramp 16. The nozzle duct has vertical side walls and a bottom wall that is formed primarily by this gate 30 and the contiguously positioned gate 28 in tandem relationship therewith. Both gates are pivotally mounted at their upstream edges in a common horizontal plane, and, as previously indicated, are driven to be oscillated or reciprocated up and down, one (the gate 30, nearest orifice 27) at a frequency that is a multiple of the frequency of the other gate. An air supply duct 32 containing pressurized air delivered by a blower (not shown) is connected to the receiving or larger end of the tapered nozzle duct 15 as depicted.

Underlying the gates 30 and 28 is gate positioning and oscillating mechanism to be described. This mechanism is suitably enclosed within a housing including an end wall 15*b* and side walls 15*c* conveniently made coplaner with the side walls of chute 14. The housing extends toward the fire box into a boxlike chamber 17 lying beneath the ramp 16. This gate mechanism housing bottom wall 92 comprises a hinged trap door used for gaining access to the mechanism. A vertical trap door 90 on the front wall of the chamber 17 provides access to the ramp 16 and a port for viewing combustion conditions on the grate 12.

As will be seen, gates 28 and 30 extend the full width of nozzle duct 15. With orifice-defining gate 30 in its lowermost position resting on the upper edge of ramp 16, the vertical width of the orifice 27 in a typical installation such as that mentioned will be approximately three-fourths inch. In such an installation, wherein the grate is five feet wide and ten feet long, the horizontal width of the nozzle orifice 27 is approximately two feet. With these relative dimensions the air dispersal system is capable of spreading the intercepted fuel particles substantially throughout the width and length of the fire box or grate 12 with good uniformity on a time-averaged basis.

Oscillatable gate 30 is L-shaped in vertical longitudinal section. Its main (i.e., generally horizontal) panel is hingedly supported by its upstream edge on a hinge 20*a* secured to the horizontal upper edge of a transverse frame member 42. Gate 28 comprises a generally horizontal flat panel 28*c* supported for pivoting by hinge means 28*a* mounted along the upper edge of a second transverse horizontal frame member 40. The relative positioning is such that the downstream free edge of the gate 28 is substantially contiguous to the hinged edge of the gate 30 as shown. The free or downstream end of gate 30 is curved slightly downwardly so as to provide a slight flare to the orifice 27, there being a similar flaring curvature formed by the juncture between the instersecting panels 14*a* and 15*a*. The second part or panel 28*b* of gate 28 is turned downwardly at right angles so as to bridge across the varying gap between the gate 28 and the pivoted edge of gate 28.

The preferred means employed to oscillate the two gates 28 and 30 up and down periodically in the intended manner includes lifter cams, coordinated rotation of which deflects the respective gates upwardly by periodically varying amounts against the downward return force of hold-down springs. Gate 30 normally rests on eccentric cam 64, but may rest on a transverse frame member 58 if cam 64 is removed or shifted to its lowermost retracted position. This gate is subjected to continuous downward force provided by spring 50 surrounding and held captive by hold-down bolt 46. Guided through an aperture in the bottom flange of the frame member 42, the bolt is oriented generally vertically and fastened by its upper end to the gate. As the drive shaft 66 turns the eccentric cam 64, the gate 30 rises and descends periodically at the frequency of shaft rotation. In a similar manner, gate 28 is oscillated or reciprocated up and down by means of an eccentric cam 60, eccentrically mounted on cam shaft 62 and working against the downward return force of spring 48 surrounding and held captive by the hold-down bolt 44. Like the bolt 46, bolt 44 is guided through an aperture in the lower flange of a transverse frame member, 40. A stop or rest 52 for the gate 28 is afforded by the transverse frame member 52 corresponding to frame member 54.

Shafts 62 and 66 are driven in rotation at related speeds, shaft 62 at twice that of shaft 66. They are driven by a geared-down electric motor 68 that may be of the variable-speed type coupled to the shafts through a system of chains and sprockets including chains 70 and 74 and associated sets of sprockets 71, 72 and 78, 76, respectively, in order to achieve the desired oscillation frequencies of the flow restrictor gates 28 and 30. In a typical case, with hogged fuel being fed to a furnace generally of the type and size described, and with nozzle air pressurized at approximately one to one and a quarter pounds above atmospheric pressure, the system works best with gate 28 oscillated vertically through a range of approximately 1-½ inches of travel of its downstream edge at the rate of two cycles per minute, while gate 30 is oscillated through a range of approximately one half inch at four cycles per minute (i.e., exactly twice the oscillating frequency of gate 28).

As a further feature of the illustrated mechanism of this invention, cam shafts 62 and 66 are vertically adjustable so as to permit varying the average positions of the reciprocating gates 28 and 30 and thereby the average modulated airflow velocity through the duct 15. For this purpose, each such cam shaft is journalled on and between a set of two support arms 80 pivoted by one end at 82 and with ends lodged between aligned positioning studs 84. These studs serve as stops threaded in the arms of a stationary bracket 88. By backing off on one such stud and advancing the other, the setting of the cam shaft may be adjusted vertically as desired. In this way, the gates may be caused to undergo their oscillations through a range established by the throw of their respective drive cams, which range can be shifted up of down in the nozzle duct so as to vary the average velocity effort of the gates in modulating flow through the nozzle.

If desired, the degree of eccentricity or throw of the cams 60 and 66 may also be made adjustable by any of suitable or conventional means that alter the radial offset between the centers of the eccentric cams and the centers of their respective cam shafts.

It is found in the operation of the improved air dispersal velocity modulating mechanism of this invention that the use of the two described tandemly related, flow restrictor gates in the nozzle duct provides time-averaged uniformity of physical distribution of the varying sizes and densities of fuel particles and of the combustion of such particles over the area of the furnace grate yielding much superior efficiency and volumetric combustion capabilities to that achieved with a single oscillating air flow restrictor gate in a jet nozzle duct.

These and other aspects of the invention, including equivalents of the illustrated embodiments thereof will be recognized by those skilled in the art, and are intended to be included within the scope of interpretation of the claims that follow.

What is claimed is:

1. Apparatus for dispersing hogged fuel pneumatically with improved combustion distribution over the area of a furnace fire grate comprising, in combination with means for discharging hogged fuel particles downwardly toward the grate in a free fall trajectory, air duct means adapted to receive pressurized air at one end and having a discharge orifice at its opposite end directed in intersecting relationship with said trajectory to blow the fuel particles therefrom out over the area of the grate, tandemly positioned oscillatable airflow restrictor gates each operably mounted in said duct means to vary the air velocity flowing through said orifice, and drive means operable to oscillate one such gate at a multiple of the frequency of the other.

2. The combination defined in claim 1, wherein the duct means is tapered toward the discharge orifice and wherein the gate nearest the discharge orifice is oscillated at twice the frequency of the other gate.

3. The combination defined in claim 2, wherein the gates are oscillated with such relative phasing that the gate nearest the discharge orifice reaches alternate ones of its most flow-restricting position in substantial time coincidence with the other gate reaching its most flow-restricting position.

4. The combination defined in claim 3, and means operable to vary the average flow-restricting positions of the oscillating gates independently of the respective ranges of oscillation of such gates.

5. The combination defined in claim 4, wherein the gates are pivotally mounted, spring means yieldably urging the gates toward their least flow-restricting positions, and rotative eccentric cam means operable to move the respective gates cyclically to their most flow-restricting positions against said spring means.

6. The combination defined in claim 5, wherein the discharge duct means has an upper wall sloping downward toward the discharge orifice and wherein the gates comprise flat plate members disposed generally horizontally in a common plane and cooperatively forming a lower wall beneath said sloping upper wall.

7. The combination defined in claim 6, wherein the gate furthest from the orifice has a downturned flange that bridges the variable gap between said gate and the other gate in the varying positions of oscillation of the gates.

8. The combination defined in claim 1, and means operable to vary the average flow-restricting positions of the oscillating gates independently of the respective ranges of oscillation of such gates.

9. The combination defined in claim 8 wherein the drive means operate to oscillate each of said gates in a simple harmonic motion.

10. The combination defined in claim 3 wherein the drive means operate to oscillate each of said gates in a simple harmonic motion.

* * * * *